US006026805A

United States Patent [19]

Burch et al.

[11] Patent Number: 6,026,805

[45] Date of Patent: Feb. 22, 2000

[54] HEATING APPARATUS

[75] Inventors: Tracy J. Burch, Dry Ridge; Daniel E. Newman, Georgetown; Soong Jack Chow, Lexington, all of Ky.

[73] Assignee: Monessen Hearth Systems, Inc., Paris, Ky.

[21] Appl. No.: 09/036,154

[22] Filed: Mar. 6, 1998

[51] Int. Cl.[7] ..... F23C 1/18; F24B 1/18

[52] U.S. Cl. ..... 126/512; 126/92 R; 126/528; 126/500

[58] Field of Search ..... 126/512, 500, 126/92 R, 92 B, 528, 529, 307 R, 312; 431/125; 110/203, 205, 211

[56] References Cited

U.S. PATENT DOCUMENTS

| | | | |
|---|---|---|---|
| 1,621,135 | 3/1927 | Sala | 126/512 |
| 1,703,459 | 2/1929 | Sala | 126/92 R |
| 1,726,000 | 8/1929 | Sala | 126/92 AC |
| 1,884,746 | 10/1932 | Kline et al. | 126/92 AC |
| 2,782,780 | 2/1957 | Bourner | 126/92 R |
| 4,194,490 | 3/1980 | Crnkovic | 126/553 |
| 4,319,556 | 3/1982 | Schwartz et al. | 126/77 |
| 4,422,437 | 12/1983 | Hirschey | 126/77 |
| 4,458,662 | 7/1984 | Barnett | 126/77 |
| 4,672,946 | 6/1987 | Craver | 126/77 |
| 4,688,545 | 8/1987 | Patterson | 126/77 |
| 4,688,548 | 8/1987 | Stoughton | 126/553 |
| 4,691,686 | 9/1987 | Alvarez | 126/502 |
| 4,793,322 | 12/1988 | Shimek et al. | 126/512 |
| 4,890,600 | 1/1990 | Meyers | 126/512 |
| 4,909,227 | 3/1990 | Rieger | 126/521 |
| 4,919,120 | 4/1990 | Horikoshi et al. | 126/92 B |
| 4,971,031 | 11/1990 | Richardson | 126/512 |
| 5,000,162 | 3/1991 | Shimek et al. | 126/512 |
| 5,069,200 | 12/1991 | Thow et al. | 126/512 |
| 5,078,122 | 1/1992 | Kalenian | 126/299 R |

(List continued on next page.)

FOREIGN PATENT DOCUMENTS

| | | |
|---|---|---|
| 610 285 | 2/1935 | Germany . |
| 428393 | 5/1935 | United Kingdom . |
| 571 924 | 9/1945 | United Kingdom . |
| 661919 | 11/1951 | United Kingdom . |
| 681 840 | 10/1952 | United Kingdom . |
| 2 087 542 | 5/1982 | United Kingdom . |
| 2 203 532 | 10/1988 | United Kingdom . |
| 2 216 252 | 10/1989 | United Kingdom . |
| 2 261 942 | 6/1993 | United Kingdom . |

*Primary Examiner*—Ira S. Lazarus
*Assistant Examiner*—David Lee
*Attorney, Agent, or Firm*—Woodard, Emhardt, Naughton Moriarty & McNett Patent and Trademark Attorneys

[57] ABSTRACT

A vent-free, gas fireplace for providing heat, light, and an aesthetic view includes an outer shell arranged with a top panel, front panel, rear panel, and left and right side panels and a combustion chamber positioned within the outer shell so as to define a plurality of air chambers. The combustion chamber is arranged with a primary combustion portion for initial combustion of the gas which is supplied to the fireplace and a secondary combustion portion which includes a catalytic converter and which is designed to bum the emissions from the primary combustion portion. The plurality of air chambers defined between the outer shell and combustion chamber include a rear chamber and a top chamber and positioned within the top chamber is a heat shield which defines an interior volume. The interior volume of the heat shield is in flow communication with the rear chamber so as to direct air through the heat shield and out into the room. The heat shield helps to maintain a lower temperature for the top panel of the outer shell. The front panel for the outer shell, which includes the front panel for the combustion chamber, defines a first air inlet for combustion air, a second air inlet for cooling air, a first air exhaust in flow communication with the secondary combustion portion, and a second air exhaust in flow communication with the top chamber.

25 Claims, 4 Drawing Sheets

U.S. PATENT DOCUMENTS

| | | | |
|---|---|---|---|
| 5,081,981 | 1/1992 | Beal | 126/512 |
| 5,127,392 | 7/1992 | Mizuno et al. | 126/92 R |
| 5,139,011 | 8/1992 | Moon | 126/512 |
| 5,429,495 | 7/1995 | Shimek et al. | 431/126 |
| 5,571,008 | 11/1996 | Richardson et al. | 431/125 |
| 5,647,340 | 7/1997 | Shimek et al. | 126/85 B |
| 5,655,514 | 8/1997 | Kowald et al. | 126/531 |
| 5,673,683 | 10/1997 | Beal et al. | 126/531 |
| 5,678,534 | 10/1997 | Fleming | 126/512 |
| 5,752,500 | 5/1998 | Jamieson et al. | 126/512 |
| 5,782,231 | 7/1998 | Wade | 126/200 |
| 5,816,237 | 10/1998 | Fleming | 126/512 |

HEATING APPARATUS

BACKGROUND OF THE INVENTION

The present invention relates in general to a heating apparatus for providing heat, light, and aesthetics to the interior of a structure, and the preferred embodiment of this heating apparatus is a vent-free, gas fireplace. More specifically, the present invention relates to a vent-free, gas fireplace which is equipped with a catalytic converter for secondary combustion of the primary combustion exhaust or emissions.

The use of a catalytic converter for a vent-free fireplace is known in the art as disclosed by U.S. Pat. No. 5,678,534 which issued Oct. 21, 1997 to Fleming. One purpose of the catalytic converter is to ensure that most of the unburned hydrocarbons and/or carbon monoxide, the by-products of the primary combustion, are converted to carbon dioxide and water. This enables the emissions from the catalytic converter to be exhausted directly into the room of the structure where the fireplace is positioned. By converting the unburned hydrocarbons and/or carbon monoxide to carbon dioxide and water, the emissions are not harmful and the fireplace does not need to vent any of the emissions to the outside atmosphere, thus enabling a vent-free fireplace design. As will be explained with regard to the present invention, the characteristics of its primary combustion are such that the by-products of that primary combustion meet, from a safety standpoint, the applicable standards, allowing these combustion by-products to be exhausted directly in to the room of the structure where the fireplace is positioned.

To the extent the '534 Fleming patent represents traditional thinking, it is seen that such traditional thinking includes a separate air pathway in the primary combustion chamber. Air pathway (14) of the '534 Fleming patent is provided behind a reflective sheet for helping to control the temperature of the reflective sheet and reduce heat transfer from the vicinity of the reflective sheet (11) rearwardly of the heater. The configuration of the firebox relative to the outer casing and the placement of the reflective sheet create three air convection pathways. Ultimately all three are mixed prior to being exhausted out into the room through outlet (10). Two of the corresponding flow paths are directed to the uppermost portion of the firebox and into the catalytic converter. As such, the separate air pathway (14) created in part by the reflective sheet, is used in part to provide a source of supplemental oxygen or air to the catalytic converter.

The creation of a separate air pathway for a supply of oxygen or air to the catalytic converter requires at least one additional component to be incorporated into the overall assembly. Whether this additional component is a reflective sheet or some other partitioning panel, its addition represents an added complexity and added cost to the corresponding heating apparatus (i.e., fireplace). The partitioning created by this reflective sheet also reduces the size of the combustion chamber volume for a given firebox size. This is believed to have a negative effect on primary combustion, necessitating the secondary flow of air (oxygen) for the catalytic converter. It would therefore be a design improvement if the construction complexity of the fireplace, as depicted by the Fleming patent, could be simplified without sacrificing the cleanliness of the emissions from the combustion chamber so that these emissions could be safely exhausted directly into the room of the structure. Such an improvement is provided by the present invention as briefly described below and as explained in greater detail in the description of the preferred embodiment.

With reference to the structure of the present invention, it will be understood that during the combustion process, outside (room) air flows into the primary combustion chamber where a gas burner is located. This flow pattern is due simply to the natural phenomenon of thermal buoyancy, i.e., warm air rises. This same air flow phenomenon is used to route an incoming flow of air into an outer air chamber (i.e., blanket) which surrounds the combustion chamber. By the proper balancing of the flow of fresh air in and exhaust air out from the primary combustion chamber, it is possible to attain and maintain a self-sustaining combustion process through the catalytic converter which is used in the present invention. In part, this combustion result is achieved by eliminating any secondary pathway within the primary combustion chamber and by isolating the flow of cooling air in the outer chamber from the primary combustion chamber.

As the hot air from the primary combustion process rises and draws in more combustion air, the rate of incoming flow is influenced in part by the temperature of the exiting air flow (post-combustion). By not mixing the second flow path of cooling air with the combustion emissions, sufficient air is drawn into the primary combustion chamber and into the catalytic converter for the combustion needs and in order to sustain the combustion process through the catalytic converter. This absence or lack of any mixing of the air flows is in sharp contrast to the teachings and structure of Fleming which mixes the air flows which are prior to or upstream of the catalytic converter. There is also mixing of the flow streams after or downstream of the catalytic converter. The mixing of these flows was the focus of arguments advanced in support of the patentability of the Fleming device.

SUMMARY OF THE INVENTION

A gas fireplace for providing heat, light, and an aesthetic appearance according to one embodiment of the present invention comprises an outer shell including a top panel, front panel, rear panel, and left and right side panels; a combustion chamber positioned within the outer shell and including a primary combustion portion and a secondary combustion portion such that the secondary combustion portion includes a catalytic converter, the combustion chamber including a top panel, rear panel, base panel, and left and right side panels; a plurality of air chambers are disposed between the combustion chamber and the outer shell such that each air chamber of the plurality is separated from and free of any flow communication with the combustion chamber. The plurality of air chambers includes a rear chamber defined by the rear panel of the combustion chamber and the rear panel of the outer shell and a top chamber defined by the top panel of the combustion chamber and the top panel of the outer shell. A heat shield is positioned in the top chamber above the top panel of the combustion chamber and defines an interior volume, the interior volume being in flow communication with the rear chamber. The front panel of the outer shell includes a first air inlet providing combustion air, a second air inlet providing cooling air, a first air exhaust for the combustion emissions from the secondary combustion portion, and a second air exhaust for the exiting flow from the top chamber.

One object of the present invention is to provide an improved vent-free, gas fireplace.

Related objects and advantages of the present invention will be apparent from the following description.

DESCRIPTION OF THE PREFERRED EMBODIMENT

Figure 1:
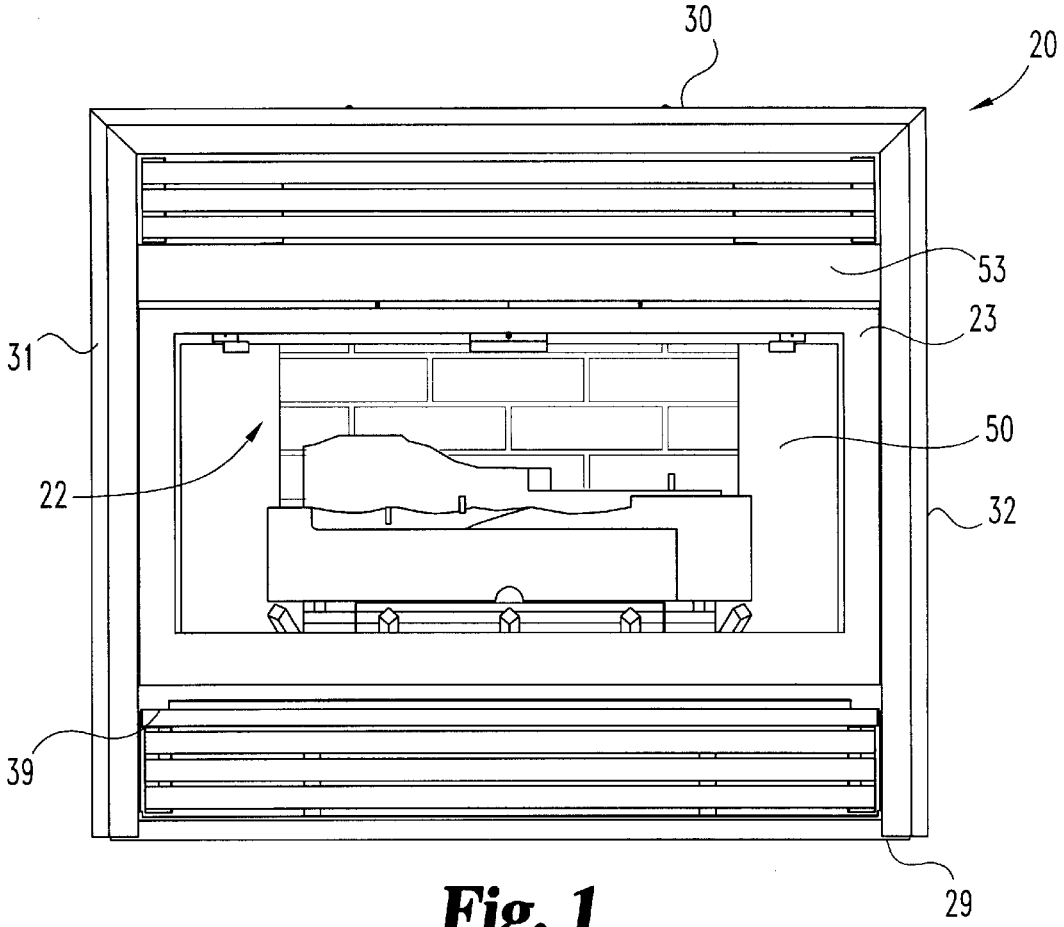
FIG. 1 is a front elevational view of a gas fireplace according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
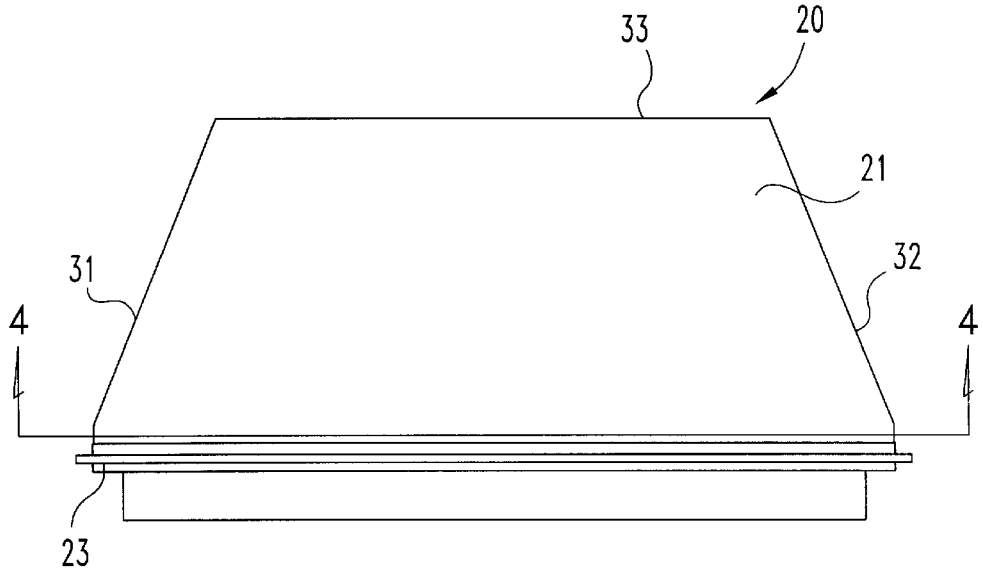
FIG. 2 is a top plan view of the FIG. 1 fireplace.
Figure 3:
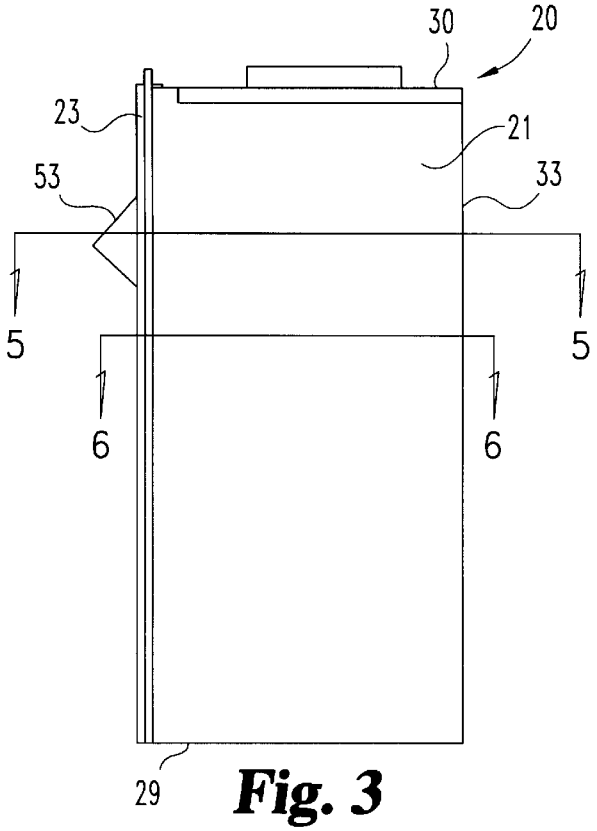
FIG. 3 is a right side elevational view of the FIG. 1 fireplace.
Figure 4:
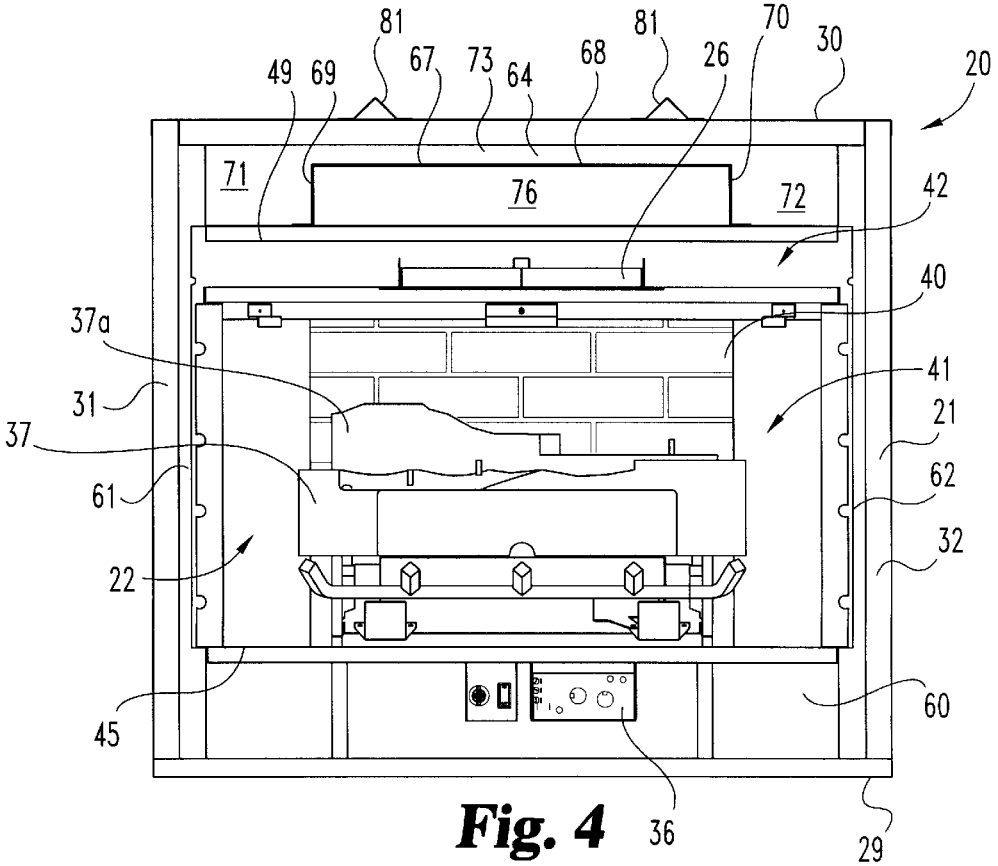
FIG. 4 is a front elevational view in full section of the FIG. 1 fireplace as viewed along lines 4—4 in FIG. 2 in the direction of the arrows.
Figure 5:
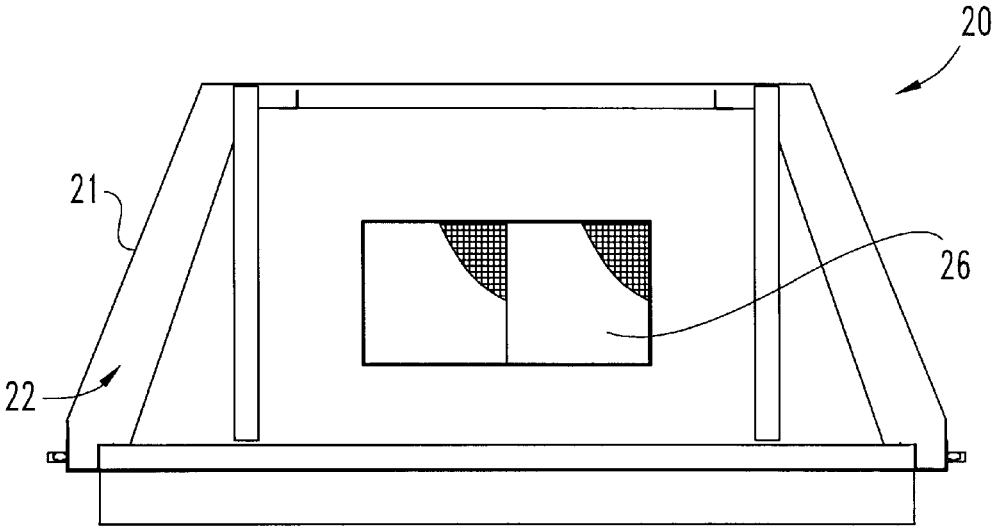
FIG. 5 is a top plan view in full section of the FIG. 1 fireplace as viewed along lines 5—5 in FIG. 3 in the direction of the arrows.
Figure 6:
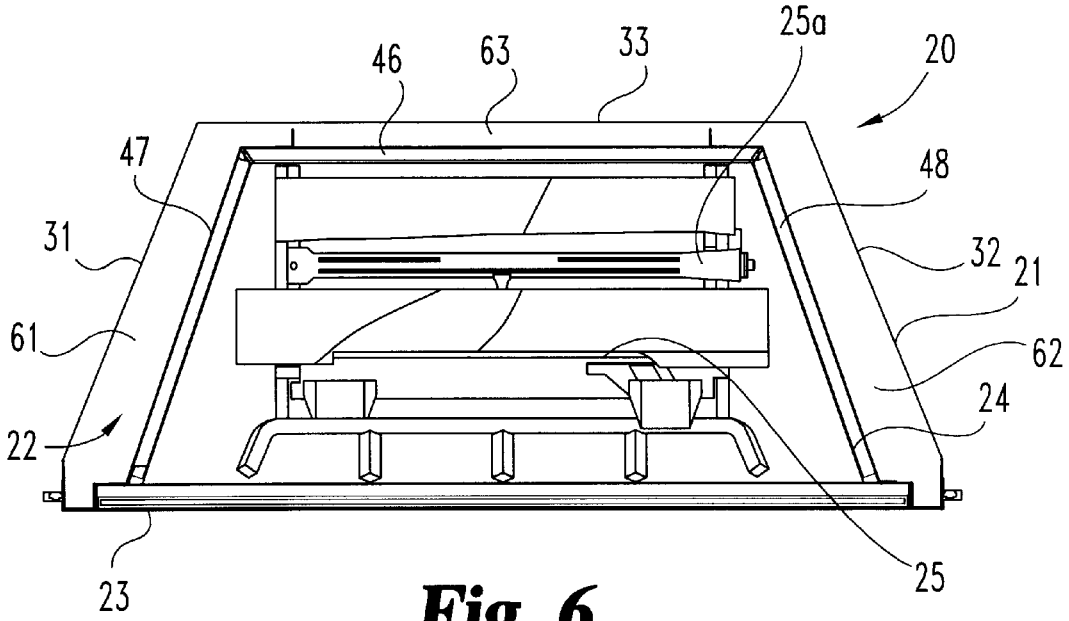
FIG. 6 is a top plan view in full section of the FIG. 1 fireplace as viewed along lines 6—6 in FIG. 3 in the direction of the arrows.
Figure 7:
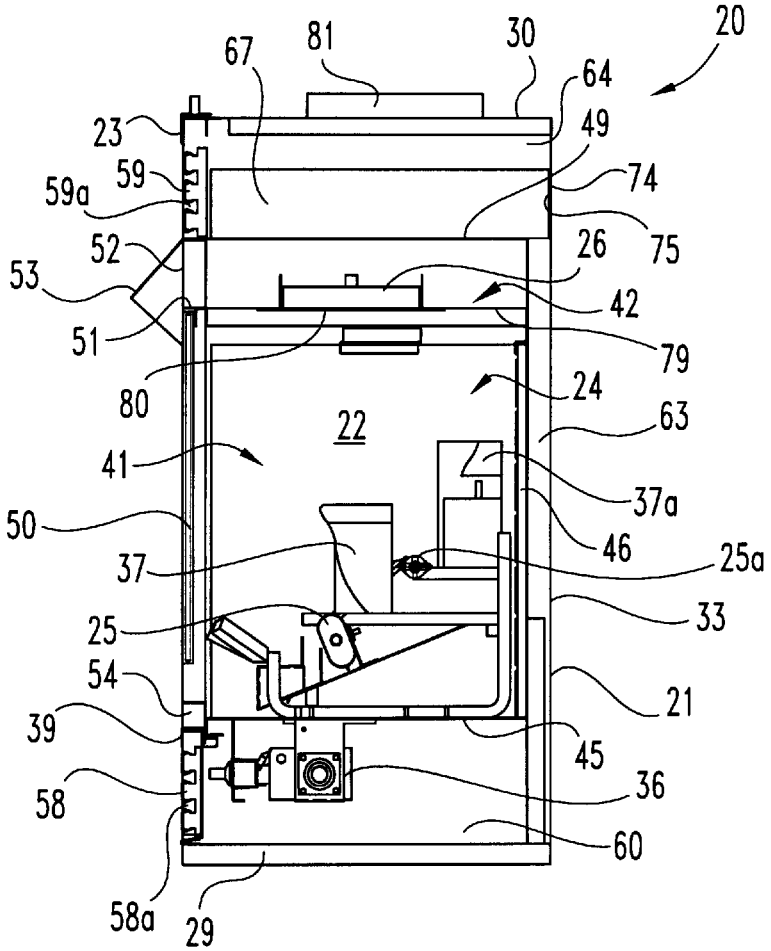
FIG. 7 is a right side elevational view of the FIG. 1 fireplace with its right side panel removed.
Figure 8:
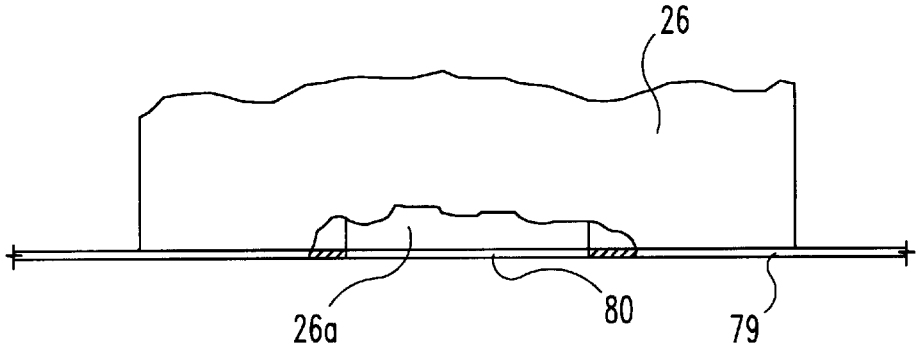
FIG. 8 is an enlarged, partial detail, right side elevational view of a catalytic converter and mounting plate comprising portions of the FIG. 1 fireplace.

Referring to FIGS. 1–3, there is illustrated a vent-free, gas fireplace 20 constructed and arranged in accordance with the present invention. In FIGS. 4–6, section views are illustrated in accordance with the corresponding cutting planes in FIGS. 2 and 3. In FIGS. 7 and 8 the right side outer panel has been removed in order to further illustrate the interior features of fireplace 20. Collectively, these seven views illustrate all of the important features and components with regard to the present invention and the balance of any construction details or specifics as to materials and mechanical connections are items which would be well known to a person of ordinary skill in this art.

Fireplace 20 includes an outer shell 21 which defines an interior space 22 therein, a front panel 23 which comprises one portion of the outer shell, a combustion chamber (firebox) 24 positioned within the interior space 22, at least one gas burner 25 positioned within the combustion chamber 24, and a catalytic converter 26 which is provided as part of a catalytic converter assembly positioned within the combustion chamber. In addition to front panel 23, the outer housing or shell 21 includes a base 29, top panel 30, left side panel 31, right side panel 32, and rear panel 33. These various portions are constructed and arranged so as to provide a suitable unit for installation into the selected room of a structure. In the preferred embodiment, sheet metal components are made from galvanized steel or alternatively from galvannealed or aluminized steel. Those sheet metal components which are directly exposed to the combustion sites are made from aluminized steel.

The gas burner 25 includes a burner mechanism coupled to a source of LP or natural gas and a set of manual controls 36. Also included is an arrangement 37 of artificial logs. In order to enhance the overall visual effect and the level of heat which is generated, a second gas burner 25*a* and a second arrangement 37*a* of artificial logs is included. The second burner and the second arrangement of artificial logs is recessed and elevated from the first burner and first arrangement for a stacked or terraced effect. The burners are made from a 300 series stainless steel for its resistance to corrosion. The manual controls 36 for the gas burners and for the operation of fireplace 20, generally, are located behind a lower access panel 39. Optional features for fireplace 20 include a hand-held remote and receiver as well as a wired wall switch (neither of which are illustrated).

The combustion chamber 24 is lined with fiber ceramic firebricks 40 which simulate the appearance of a conventional brick fireplace. The combustion chamber 24 actually includes two portions, a primary combustion portion or chamber 41 which houses the gas burners 25 and 25*a* and a secondary combustion portion or chamber 42 which houses the catalytic converter 26.

The purpose of using a catalytic converter 26 as a means of secondary combustion is to ensure that most of the unburned hydrocarbon and carbon monoxide from the primary combustion are converted to carbon dioxide and water. By a proper balancing of the flow of combustion air into the combustion chamber 24 and the flow of air out of the combustion chamber 24, the present invention is able to attain a self-sustaining combustion process through the catalytic converter 26. As a result of this design, there is no need to create any mixing chamber upstream from the catalytic converter 26 nor is there any need to introduce a fresh supply of combustion air directly into the catalytic converter 26. The sizing of the catalytic converter 26 is dependent upon the input BTUs, the amount of aeration, the volume of the combustion chamber, the temperature in the combustion chamber, and the back pressure generated during the combustion process. The inlet air temperature in the combustion chamber 24, in the vicinity of the gas burners 25 and 25*a*, is between 250 degrees F. and 400 degrees F. The aeration of the area immediately adjacent to the burners is important in order to help ensure clean combustion.

The BTU input ranges from 19,000 to 29,000 for fireplace 20 and two pieces of CORNING brand catalytic filter is suitable for this BTU range. These two pieces of catalytic filter each measure 5.91 inches by 5.91 inches.

As previously described, the combustion chamber 24 is positioned inside the outer shell 21 in what has been described as the interior space 22. The combustion chamber 24 is of a generally rectangular solid form, (i.e., box-like) with a front panel, base shelf 45, rear panel 46, side panels 47 and 48, and top panel 49. In effect, front panel 23, which is the front panel to the outer shell, provides the front panel portion for combustion chamber 24. A clear glass panel 50 which is received within a cooperating frame 51 is the portion of panel 23 that comprises the front panel of the primary combustion chamber 41. The front "panel" of the secondary combustion chamber 42 is a defined outlet opening 52 positioned behind canopy 53. As will be explained in additional detail, combustion air is drawn into the primary combustion chamber 41 by way of inlet opening 54 which is adjacent the lowermost edge of glass panel 50.

The by-products (i.e., emissions) from the gas combustion which occurs within the primary combustion chamber 41 are all routed into the secondary combustion chamber 42 where further combustion occurs by way of the catalytic converter 26. The emissions from this secondary combustion are exhausted into the room by way of outlet opening 52 and from there directed downwardly by means of canopy 53.

Front panel 23, in addition to including glass panel 50, frame 51, outlet opening 52, and inlet opening 54, also includes air inlet louvers 58 and exhaust air louvers 59. The box-like shape of the combustion chamber 24 is sized so as to fit within outer shell 21 with clearance spaces on five sides. This assumes that the front panel 23 for the outer shell is virtually one and the same as the front panel portion for the combustion chamber 24.

As is illustrated in FIGS. 4–8, cooling air is drawn into lower air chamber 60 by way of the series of inlet louvers 58. The air inlet louvers 58 segment the air inlet into chamber 60 into a plurality of inlet air flow apertures 58*a*. Chamber 60 is defined by base shelf 45, base 29, side panels 31 and 32, and the inlet louver portion of front panel 23. Side air chambers 61 and 62 are located on opposite sides of the combustion chamber 24. Left chamber 61 is defined primarily by side panel 47 and side panel 31. Right chamber 62 is defined primarily by side panel 48 and side panel 32. Rear chamber 63 is defined primarily by rear panel 46 and rear panel 33. As would be understood, air chambers 60, 61, 62, and 63 are each in open air flow communication with each other so as to create, in effect, a surrounding air envelope or blanket for combustion chamber 24.

The top air chamber 64 which completes the fifth and final side of the enclosing air envelope is defined primarily by top panel 49, top panel 30, the two side panels 31 and 32, the rear panel 33, and the exhaust air louvers 59 of the front panel 23. Chamber 64 is in air flow communication, either directly or indirectly, with air chambers 60–63. Positioned within the top air chamber 64 is a heat shield 67 which is constructed and arranged as a three-sided (or three-panel) box-like member, open on the bottom and on the ends. As such, heat shield 67 includes a top panel 68 and opposite side panels 69 and 70 which are substantially parallel to each other and substantially perpendicular to top panel 68, see FIG. 4. Since the side-to-side width of heat shield 67 is less than the width of chamber 64 between side panels 31 and 32, a first space 71 is provided between side panel 31 and side panel 69 and a second space 72 is provided between side panel 32 and side panel 70. Top panel 68 is spaced apart from top panel 30 so as to define a third clearance space 73. The rear edge 74 of heat shield 67 abuts up against the inside surface 75 of rear panel 33 directly above top panel 49 of the combustion chamber 24.

The open bottom portion of the heat shield 67 permits cooling air from rear chamber 63 to flow upwardly, directly into the interior space 76 of the heat shield defined by the top panel 68 and the two side panels 69 and 70. This flow of air becomes a heated flow due to its proximity to and flow across the (upper) top panel 49 of combustion chamber 24 which corresponds to the top panel of the secondary combustion chamber 42. This helps to insulate the air flow above the heat shield 67 and below the top panel 30. As a result, the temperature of top panel 30 is able to be maintained at an acceptably low level so as to not interfere in an adverse fashion with the surrounding portions of the structure where the fireplace 20 is to be installed. Air flow also occurs through spaces 71 and 72 and this flow exits along with the flow through space 76 out through louvers 59. The exhaust air louvers 59 segment the exhaust air outlet from chamber 64 and space 76 into a plurality of exhaust air apertures 59*a*.

Operation of fireplace 20 begins with the operation of the gas burners 25 and 25*a* and the generation of a suitable flame through the arrangements 37 and 37*a* of artificial logs. The fireplace is turned on using a piezo (spark) igniter, and visible flames are generated at the pilot of each burner 25 and 25*a*. After a few minutes, the valve control is turned on to allow gas to flow to the burners. The flame from the pilot ignites the gas at each burner. Once the combustion chamber reaches a steady state temperature, which takes approximately one hour of fireplace operation, a yellow, dancing flame is generated and stabilized. This type of flame is believed to be aesthetically preferred, since it gives the appearance of a real fire.

As the oxygen in the air inside the primary combustion chamber 41 is utilized for burning of the gas, the combustion process continues and the surrounding and adjacent air is heated and rises from the vicinity of the burner in the direction of the secondary combustion chamber 42 and into the catalytic converter 26. This upward flow of the heated air automatically draws in additional combustion air by way of inlet opening 54. The faster the air inside the primary combustion chamber 41 rises, the greater the volume of air which is drawn in by way of opening 54.

The interior of the primary combustion chamber 41 is free of any reflective panels and free of any defined or separated air corridors, like what is found in U.S. Pat. No. 5,678,534 (Fleming), thus allowing the volume of the primary combustion chamber 41 to be maximized for the overall external size of fireplace 20 based on standard height, width, and depth dimensions. This interior space size and the rate of incoming air flow by way of opening 54 ensures that there is sufficient oxygen inside of the primary combustion chamber 41 for nearly complete combustion and thus a minimum of unburned emissions. Surplus oxygen in the primary combustion chamber 41 exits from the primary combustion chamber into catalytic converter 26 where secondary combustion occurs. By having surplus oxygen delivered to the secondary combustion chamber 41 and specifically to the catalytic converter 26, further combustion is able to take place at the catalytic converter which further combusts any unburned gas for an even cleaner set of emissions.

It is to be understood that the air flow volume into and through the primary combustion chamber 41 results in a level or degree of combustion for a vent-free fireplace such that the emissions of raw gas and carbon monoxide meet the requirements of the applicable ANSI Standard. As such, the use of a catalytic converter in the present invention is not required in order to meet these international standards. The addition of a catalytic converter as part of the present invention and the secondary combustion which it provides reduces and hopefully eliminates any level of unburned emissions such as raw gas and carbon monoxide. Due to the cleaner emissions made possible by the present invention, the structure of the present invention does not need to include a built-in CO detector as an added measure to ensure safe and worry free operation.

The emissions from the secondary combustion chamber 42 are exhausted directly into the room where fireplace 20 is installed. These emissions from the secondary combustion chamber flow through outlet opening 52 and are directed downwardly by way of canopy 53. Due to the isolation between the air chambers 60–64 and the interior of combustion chamber 24, there is no mixing of the cooling air which flows in, up, and through the five air chambers 60–64 with the combustion air in the combustion chamber 24, including both the primary combustion chamber 41 and the secondary combustion chamber 42. Two separated air flows are directed into the room, one out of chamber 64 (including a portion of flow via the heat shield 67) and one out of the secondary combustion chamber 42. Front panel 23 defines the two air inlets 54 and 58 as well as the two exhaust outlets 52 and 59. Inlet 58 and outlet 59 are defined by the plurality of louvers 58 and louvers 59, respectively. By encasing the combustion chamber 24 in a surrounding envelope or blanket of cooling air, two objectives for the present invention are achieved. First, this blanket of cooling air serves as a thermal insulator for the combustion chamber 24 so that the internal temperature can be maintained at the desired level of at least 500 degrees F. Having this target temperature is particularly important at the location of the catalytic converter mounting plate 79 which separates the primary combustion chamber 41 from the secondary combustion chamber 42 and comprises another portion of the catalytic converter assembly. The only path left open for the emissions and air from the primary combustion chamber 41 is by way of opening 80 located in plate 79 which coincides with the location of the inlet 26*a* to the catalytic converter 26. If the primary combustion chamber emissions which flow into and through the catalytic converter 26 are at a temperature of at least 500 degrees F., the desired reaction occurs, resulting in cleaner emissions being exhausted into the room. Secondly, the surrounding envelope of cooling air reduces the temperature of the enclosing panels of the outer shell, thus allowing safe installation of the fireplace into the corresponding structure. The specific portions of fireplace 20 which constitute the contact points with the structure where the fireplace 20 is installed include the rear panel 33 and the two tents 81 which are positioned on the upper surface of top panel 30. Each tent 81 has a triangular shape in order to help minimize the surface area of contact with the structure.

The addition of heat shield 67 and its specific configuration is beneficial to the objective of keeping the panel surfaces of the outer shell 21 at a safe temperature. The area directly above the secondary combustion chamber 42 is one of the hotter portions of fireplace 20. The cooling air which is routed through the interior of the heat shield 67 is heated and directed out through exhaust air louvers 59 into the room, rather than rising into the vicinity of the top panel 30. The greater the temperature of the air in the heat shield, the faster the flow rate such that the heat is conducted away from the remainder of top air chamber 64.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A gas fireplace comprising:

an outer shell including a top panel, a front panel, a rear panel, and left and right side panels;

a combustion chamber positioned within said outer shell, said combustion chamber being constructed and arranged with a primary combustion portion and a secondary combustion portion, said primary combustion portion including a gas burner, said secondary combustion portion including a catalytic converter, and said combustion chamber including a top panel, a rear panel, a base panel, and left and right side panels;

a plurality of air chambers disposed between said combustion chamber and said outer shell, each air chamber of said plurality being separated from and free of any flow communication with said combustion chamber and including a rear air chamber defined by the rear panel of said combustion chamber and the rear panel of said outer shell and a top air chamber defined by the top panel of said combustion chamber and the top panel of said outer shell;

a heat shield positioned in said top air chamber above the top panel of said combustion chamber and defining an interior volume, said interior volume being in flow communication with said rear air chamber; and said front panel defining a first air inlet for providing combustion air into said combustion chamber, a second air inlet for providing air into said plurality of air chambers, a first air exhaust in communication with said secondary combustion portion and a second air exhaust in flow communication with said top air chamber.

2. The gas fireplace of claim 1 wherein said plurality of air chambers includes first and second side air chambers on opposite sides of said combustion chamber.

3. The gas fireplace of claim 2 wherein said plurality of air chambers includes a bottom air chamber located beneath the base panel of said combustion chamber and which is in air flow communication with said rear air chamber.

4. The gas fireplace of claim 3 wherein said heat shield includes an upper wall and oppositely disposed first and second side walls.

5. The gas fireplace of claim 4 wherein said heat shield further includes a rear edge which is positioned adjacent to the rear panel of said outer shell.

6. The gas fireplace of claim 5 wherein the first side wall of said heat shield is spaced apart from the left side panel of said outer shell and defining therewith an air flow path in flow communication with said second air exhaust.

7. The gas fireplace of claim 6 wherein the second side wall of said heat shield is spaced apart from the right side panel of said outer shell and defining therewith an air flow path in flow communication with said second air exhaust.

8. The gas fireplace of claim 7 wherein said second air inlet includes a plurality of louvers which segment said air inlet into a plurality of inlet air flow apertures.

9. The gas fireplace of claim 8 wherein said second air exhaust includes a plurality of louvers which segment said air exhaust into a plurality of exhaust air flow apertures.

10. The gas fireplace of claim 1 wherein said plurality of air chambers includes a bottom air chamber located beneath the base panel of said combustion chamber and which is in air flow communication with said rear air chamber.

11. The gas fireplace of claim 1 wherein said heat shield includes an upper wall and oppositely disposed first and second side walls.

12. The gas fireplace of claim 11 wherein said heat shield further includes a rear edge which is positioned adjacent to the rear panel of said outer shell.

13. The gas fireplace of claim 12 wherein the first side wall of said heat shield is spaced apart from the left side panel of said outer shell and defining therewith an air flow path in flow communication with said second air exhaust.

14. The gas fireplace of claim 13 wherein the second side wall of said heat shield is spaced apart from the right side panel of said outer shell and defining therewith an air flow path in flow communication with said second air exhaust.

15. The gas fireplace of claim 1 wherein said second air inlet includes a plurality of louvers which segment said air inlet into a plurality of inlet air flow apertures.

16. The gas fireplace of claim 15 wherein said second air exhaust includes a plurality of louvers which segment said air exhaust into a plurality of exhaust air flow apertures.

17. The gas fireplace of claim 1 which further includes a second gas burner spaced apart from said gas burner.

18. A gas fireplace comprising:

an outer enclosure including a plurality of defining panels;

a combustion chamber positioned within said outer enclosure and including a plurality of defining walls, said combustion chamber being constructed and arranged with a primary combustion portion including a gas burner and a secondary combustion portion including a catalytic converter;

a plurality of air chambers disposed between and defined by said outer enclosure and said combustion chamber, said plurality of air chambers including a first air chamber and a second air chamber;

a heat shield positioned in said second air chamber and defining an interior space which is in air flow communication with said first air chamber; and said outer enclosure including a front panel which defines a first air inlet for providing combustion air into said combustion chamber, a second air inlet for providing air into said plurality of air chambers, a first air exhaust in flow communication with said secondary combustion portion and a second air exhaust in flow communication with said second air chamber.

19. The gas fireplace of claim 18 wherein said plurality of air chambers includes a bottom air chamber located beneath a base wall of said combustion chamber which is in air flow communication with said first air chamber.

20. The gas fireplace of claim 19 wherein said heat shield includes an upper wall and oppositely disposed first and second side walls.

21. The gas fireplace of claim 20 wherein said heat shield further includes a rear edge which is positioned adjacent to a rear panel of said outer enclosure.

22. The gas fireplace of claim 21 wherein the first side wall of said heat shield is spaced apart from a left side panel of said outer enclosure and defining therewith an air flow path in flow communication with said second air exhaust.

23. The gas fireplace of claim 22 wherein the second side wall of said heat shield is spaced apart from a right side panel of said outer enclosure and defining therewith an air flow path in flow communication with said second air exhaust.

24. The gas fireplace of claim 18 wherein said second air inlet includes a plurality of louvers which segment said air inlet into a plurality of inlet air flow apertures.

25. The gas fireplace of claim 24 wherein said second air exhaust includes a plurality of louvers which segment said air exhaust into a plurality of exhaust air flow apertures.

* * * * *

UNITED STATES PATENT AND TRADEMARK OFFICE

CERTIFICATE OF CORRECTION

PATENT NO : 6,026,805

DATED : February 22, 2000

INVENTOR(S) : Burch, et al.

It is certified that error appears in the above-identified patent and that said Letters Patent are hereby corrected as shown below:

In the ABSTRACT [57], at line 9, replace "bum" with – burn -- .

Signed and Sealed this

Third Day of April, 2001

*Attest:*

Nicholas P. Godici

NICHOLAS P. GODICI

*Attesting Officer*

*Acting Director of the United States Patent and Trademark Office*